United States Patent [19]

Nakajima

[11] Patent Number: 5,018,463

[45] Date of Patent: May 28, 1991

[54] STACKING DEVICE HAVING CLAMPS ALONG A CIRCULATING CONVEYOR FOR CLAMPING, CONVEYING, AND STACKING SEWN ARTICLES FROM A SEWING MACHINE TO A CLOTH HOLDING STAND

[75] Inventor: Nobuo Nakajima, Tokyo, Japan

[73] Assignees: Pegasus Sewing Machine Mfg., Co., Ltd., Osaka; Grace Sewing Machine Co., Ltd., Tokyo, both of Japan

[21] Appl. No.: 380,810

[22] Filed: Jul. 14, 1989

[30] Foreign Application Priority Data

Jul. 16, 1988 [JP] Japan ..... 63-177864

[51] Int. Cl.[5] ..... D05B 33/02; B65H 29/00; B65H 29/02; B65H 29/04

[52] U.S. Cl. ..... 112/121.29; 271/84; 271/85; 271/175; 271/204; 112/121.12; 112/121.15; 112/303; 112/304

[58] Field of Search ..... 112/121.11, 121.12, 112/121.15, 121.26, 121.27, 121.29, 141, 143, 147, 153, 303, 304, 306, 311, 286; 271/258, 279, 84, 85, 204, 175

[56] References Cited

U.S. PATENT DOCUMENTS

| | | | |
|---|---|---|---|
| 2,737,390 | 3/1956 | Morgan | 271/84 X |
| 2,884,244 | 4/1959 | Bowman | 271/175 |
| 3,126,848 | 3/1964 | Gastonguay | 114/218 |
| 3,391,928 | 7/1968 | Mowry | 271/204 X |
| 3,704,884 | 12/1972 | Nicolay | 271/175 |
| 3,989,239 | 11/1976 | Scriven | 271/204 |
| 4,066,028 | 1/1978 | Hornkohl | 112/121.29 |
| 4,424,965 | 1/1984 | Faltin | 271/204 X |
| 4,615,288 | 10/1986 | Matsuda | 271/85 X |
| 4,664,577 | 5/1987 | Bonali | 271/85 X |

*Primary Examiner*—Werner H. Schroeder
*Assistant Examiner*—Ismael Izaguirre
*Attorney, Agent, or Firm*—Flynn, Thiel, Boutell & Tanis

[57] ABSTRACT

A clamping mechanism installed on a circulating conveyor is composed of a clamp and a supporting plate and a latch lever axially attached to the supporting plate. The clamp is designed to be opened to a specified extent by a coiled spring. When the clamp is closed against the operation of the coiled spring, it engages with a latch of a latch lever so as to be locked.

A cloth sent out from the sewing machine advances between the opened clamp and the supporting plate. The clamp is closed by an air cylinder and clamps the cloth.

When the latch lever engages with a limiting lever set at a specified position in the direction of movement of the conveyor, the lock is unlocked, and the clamp is opened to release the cloth.

16 Claims, 8 Drawing Sheets

W2
50
55
52
59B
54B
51C
60B
60A
51B
59A
54A
62
52
62
58
W1
62
52
56
57
51A

STACKING DEVICE HAVING CLAMPS ALONG A CIRCULATING CONVEYOR FOR CLAMPING, CONVEYING, AND STACKING SEWN ARTICLES FROM A SEWING MACHINE TO A CLOTH HOLDING STAND

BACKGROUND OF THE INVENTION

1. Field of the Invention

This invention relates to a stacking device for a sewing machine for clamping cloths to be delivered from the sewing machine and carried onto a cloth holding stand, and unclamping there to pile them up on the cloth holding plate.

2. Description of the Prior Art

A variety of stacking devices for piling up cloths delivered from a sewing machine to a cloth holding stand have been known. One of the well-known devices comprises, as disclosed in the U.S. Pat. No. 3,126,848, chains which span over a space between sprockets, and jaws mounted on the chains which circulate together with the chain and are capable of being opened or closed, and are designed to open the jaws, so they can receive the cloths delivered from the sewing machine, when a chain engages with a sprocket and becomes arc shaped, and carry the cloths onto a table by clamping as soon as the clamp becomes horizontal, and to release the cloths upon reaching the other sprocket, thereby piling them up on the table.

In such a machine, however, as the clamp could only be opened or closed when it engaged with the sprockets, it was impossible to release the product at arbitrary positions between the sprockets, and as a result, the machine could be applied only to those products with a specific length. That is, it was not applied to products having a longer length than the distance between the axes of the sprockets, and even with products of a shorter length, the cloths tended not to be piled up neatly, because, when moving by clamping one end of the product, the product was moved in the state where the other end hung down and trailed.

In the above machine, the opening degree of the clamp differed depending on the diameter of the sprockets, and the machines sometimes lacked reliability in clamping and releasing the product depending on the type and description of the cloths, for example, for sprockets with a large diameter, when releasing the product, the opening degree of the clamp was too small to smoothly drop them, in particular, thick cloths, and when clamping the cloths, there was the anxiety that thick cloths or thin and tender cloths could fail to enter.

SUMMARY OF THE INVENTION

To solve the above problems, it is a primary object of this invention to present a stacking device for a sewing machine which is capable of clamping and releasing the product securely by maintaining the opening degree of the clamp constant regardless of the size of the pulleys or sprockets using chains or belts for driving a conveyor.

It is another object of this invention to make it possible to release the cloth at arbitrary positions according to the length of the cloth.

It is still another object of this invention to make it capable of keeping up with an increase in speed of the sewing machine.

According to the stacking device of this invention, the clamp having a locking means is designed to open a specific distance regardless of the size of the pulleys or sprockets, and the cloth delivered from the sewing machine enters securely between the clamp and the supporting plate which is opened a specific distance. When the clamp engages with closing means to shut and lock, the entered cloth is gripped. The clamping mechanism moves forward together with the conveyor and when it reaches the releasing means, the locking means engages with the releasing means to unlock the lock of the clamp. The clamp thereby opens by a specified quantity to release the gripped cloth.

The cloth is discharged by the releasing means as described above. As the position of the releasing means can be adjusted along the direction in which the clamping mechanism moves, it is possible to free the cloth at arbitrary positions according to the length of the cloth.

When plural or multiple clamping mechanisms are installed at a constant interval on the conveyor, the cloth delivered from the sewing machine can individually be clamped, carried onto the cloth holding stand and released, thereby making it possible to keep up with an increase in the delivery speed of the sewing machine.

Other objects, features and benefits of this invention are clarified by the detailed description below.

BRIEF DESCRIPTION OF THE DRAWINGS

FIG. 4 is a front view of the first embodiment in the waiting state before the cloth is fed in.

DESCRIPTION OF THE PREFERRED EMBODIMENT

The First Embodiment

Figure 1:
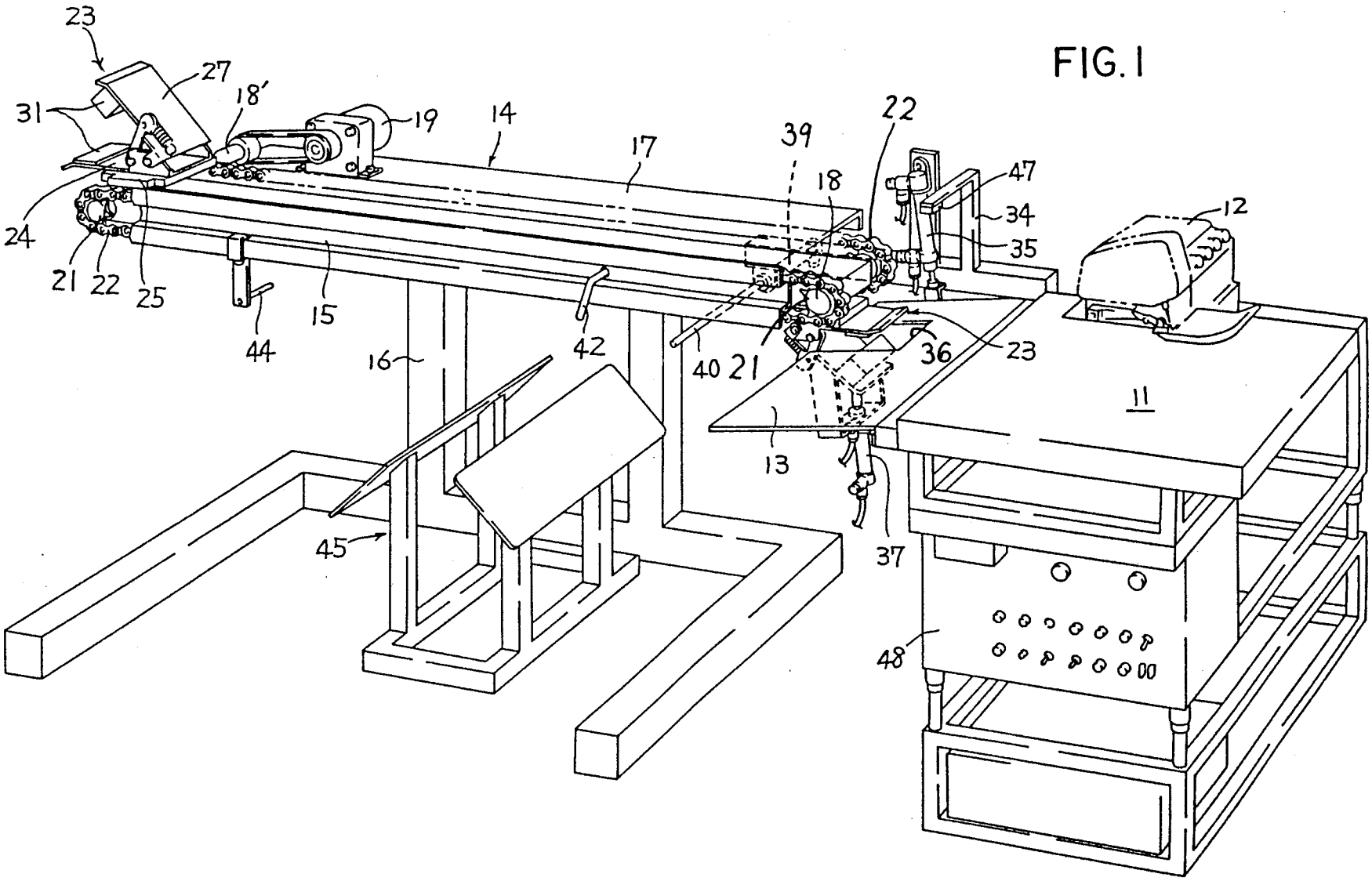
FIG. 1 is a perspective view of a first embodiment of the invention connected to a sewing machine.

On one side of a table 11, an overlock sewing machine 12 is installed, and a stacking device 14 is disposed on the delivery side, and between the table 11 and the stacking device 14, a cloth sliding plate 13 is linked by a hinge 10 to the table 11 so as to be tillable.

The stacking device 14 has a frame 17 in a rail shape which possesses a long groove (not shown) on its upper surface and concave surfaces 15 on both of its sides in the delivery direction respectively and is supported by legs 16, and on both ends of the frame 17, shafts 18, 18' are axially supported in parallel. One shaft is designed to be driven by a belt from a step motor 19 which starts or stops by synchronizing with a motor of the sewing machine.

On both ends of the shafts 18, 18', sprockets 21, 21 are mounted, and chains 22, 22, provided between the front and rear sprockets, are arranged in parallel on both sides of the long groove, and a pair of clamping mechanisms 23 are installed at symmetrical positions with respect to the chains, and are designed to circulate and move clockwise with the chains 22, 22 in FIG. 1.

The clamping mechanism 23 is composed of a supporting bracket 25 which is mounted so as to straddle the chains 22 and to which upper surface a receiving plate 24 is affixed. A clamp 27 is axially attached to the supporting bracket 25 so as to open and close and is biased by a coiled spring 26 to open. A latch lever 29 is axially attached to the supporting bracket 25 and biased by a spring 28 to rotate so as to engage with the clamp 27. Sponges 31 are mounted on the receiving plate 24 and clamp 27 at corresponding positions and the clamp 27 is closed against the actions of the coiled spring 26 and the spring 28, to clamp a cloth W between the sponges. As a means to lock this state, the clamp 27 is equipped with a hook 27', and the latch lever 29 has a latch part 29' which detachably engages with the hook 27' so as to constrain the motion of the clamp 27. In order to adjust the opening range of the clamp 27, which is biased to open by the coiled spring 26 a specific distance, a stopper pin 32, which engages with the clamp 27 at its upper side, projects from the latch lever 29.

Figure 2:
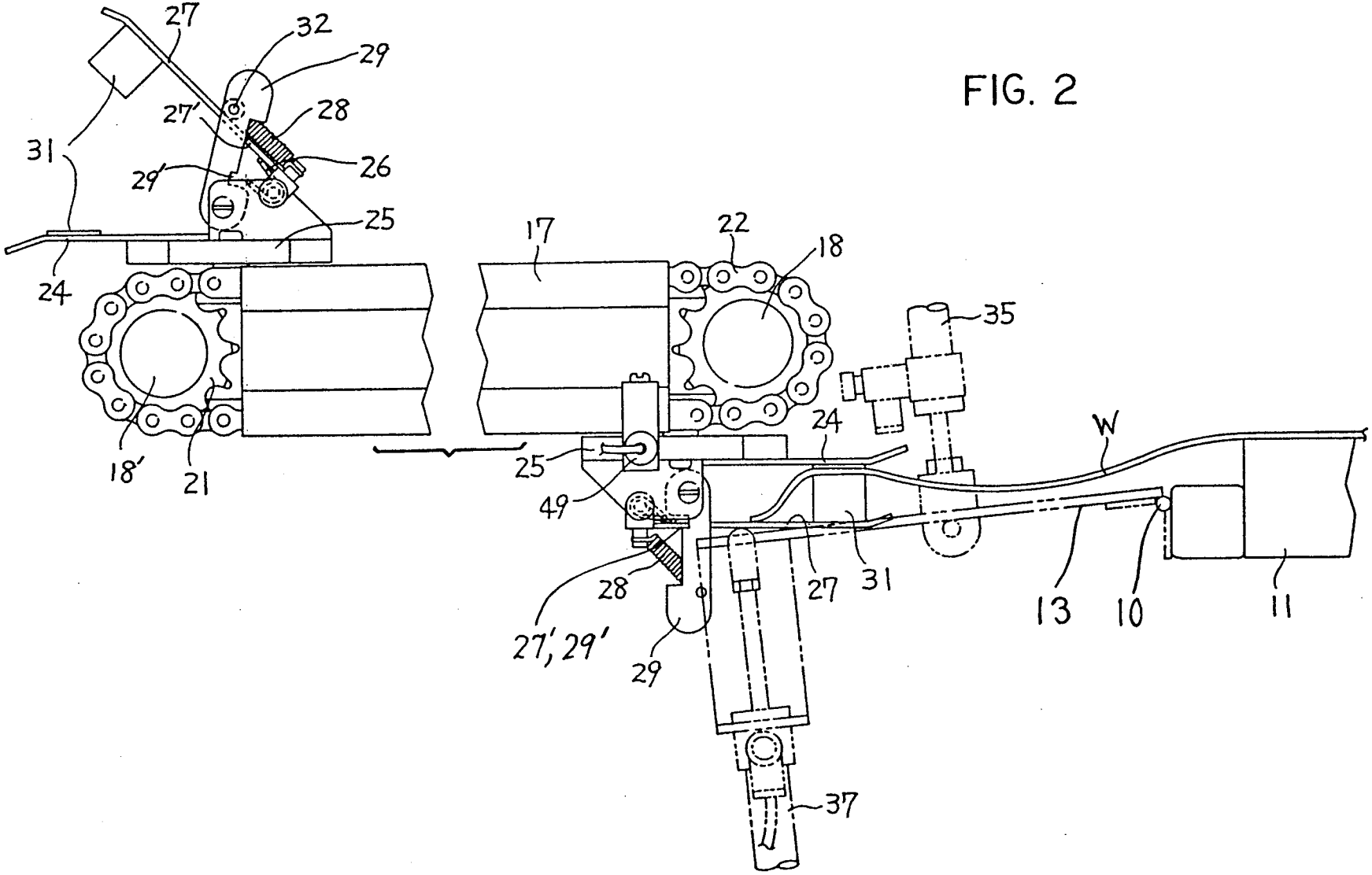
FIG. 2 is a magnified front view of the principal parts of the first embodiment.
Figure 3:
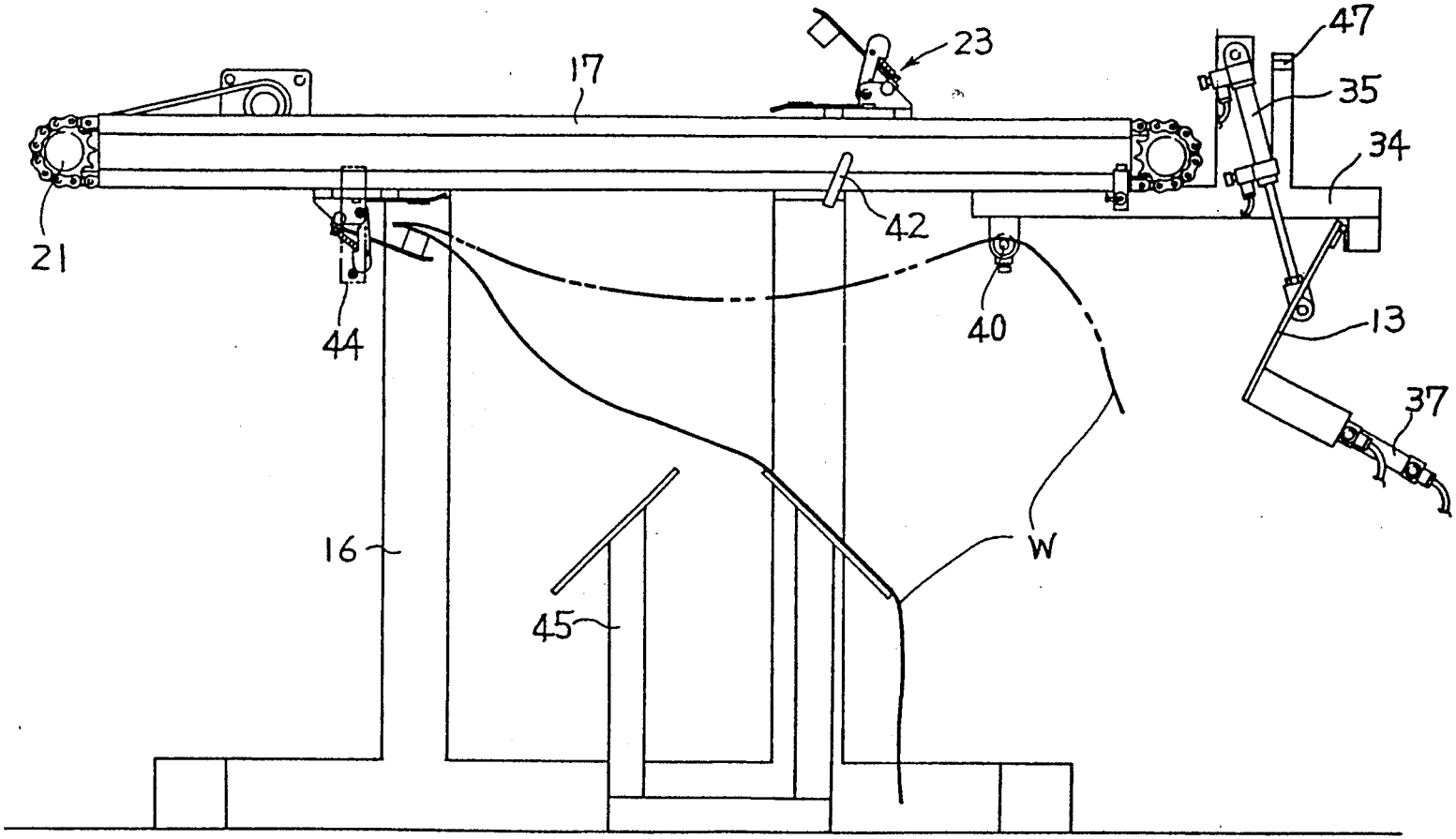
FIG. 3 is a front view of the first embodiment showing a state when the gripped cloth is released.
Figure 4:
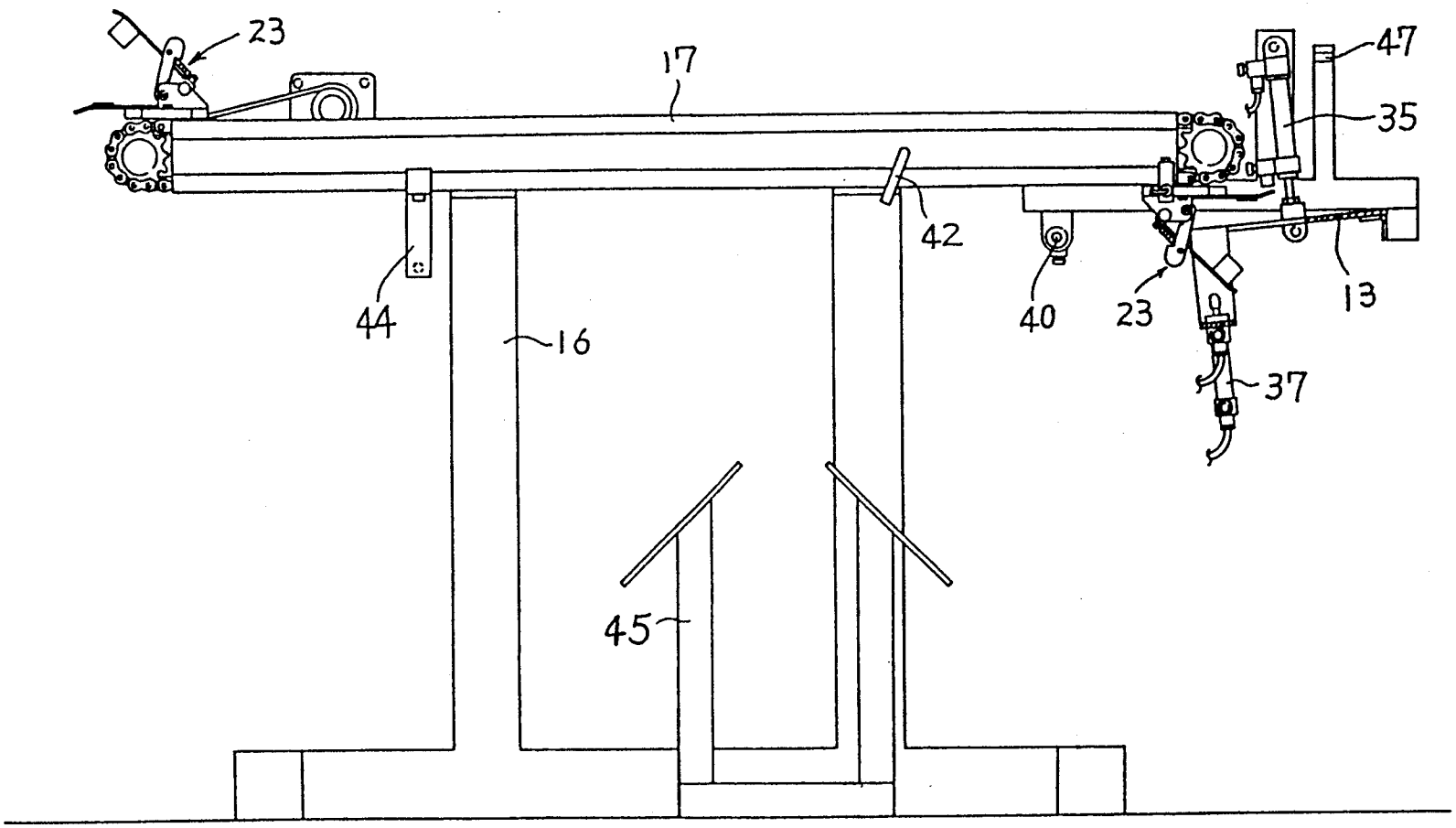
Figure 5:
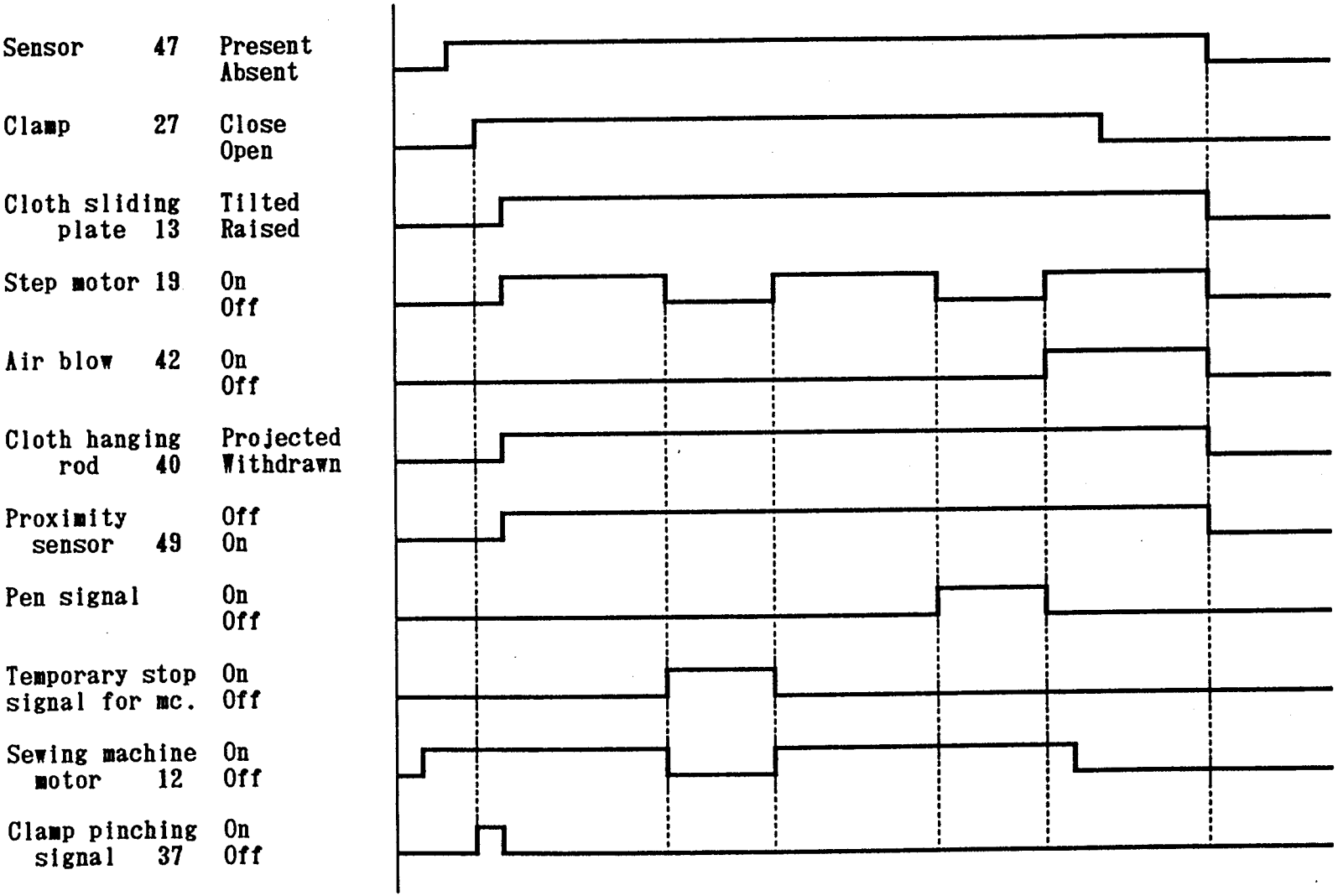
FIG. 5 is a time chart of the actions of the parts composing the first embodiment.

The cloth sliding plate 13 is coupled with an air cylinder 35, which is axially attached to an arm 34 projecting from the frame 17 toward the sewing machine 12, and can be switched by the action of the air cylinder 35 into a raised position, slightly nose-down (see FIGS. 1, 2, 4) or a collapsed position (see FIG. 3). It has a notched part 36 through which the clamping mechanism 23 passes, and an air cylinder 37 attached on its underside as a means for closing the clamp, and is designed to let the plunger advance or withdraw in the direction of the notched part 36, to push up the clamp 27 when the cloth sliding plate 13 is in the raised state slightly nose-down (FIG. 2), and to let the hook 27' engage with the latch 29' so as to constrain the motion of the clamp 27.

Here, as the closing means, it is possible to use cams or solenoids instead of air cylinders 37.

The arm 34 is equipped with an air cylinder 39 which projects in a orthogonal direction to the feeding direction beneath the circulation route of the clamping mechanism 23, and a cloth hanging rod 40 which is installed at the acting end of the air cylinder 39, advances and withdraws in a direction orthogonal to the feeding direction so as to support the cloth W clamped by the clamping mechanism 23 in its projecting state as shown by a double-dot chain line in FIG. 3.

An air nozzle 42 projects from the concave surface 15 of the frame 17 and blows air on the cloth W hung over the cloth hanging rod 40 so as to press the cloth W down and drop it from the cloth hanging rod 40, as shown by a solid line in FIG. 3, and prevent the rear end of the cloth from being rolled up.

On the concave surface 15 of the frame 17, a limiting bar 44, extending an orthogonal direction to the feeding direction, is mounted so that its position along the feeding direction, can be freely regulated and acts as a clamp-releasing means. That is, when the circulating clamp mechanism 23 moves leftward in FIG. 1 so as to engage the tip of the latch lever with the limiting bar 44, and the clamping mechanism 23 keeps moving thereafter, the latch lever 29 rotates against the action of the spring 28 so that the latch part 29' is unhooked from the hook 27'. Then the clamp 27 opens by the operation of the coiled spring 26 (see FIG. 3), releases the clamped cloth W, and stacks it over the cloth holding stand 45. When the latch lever 29 comes over the limiting bar 44, it recovers by the operation of the spring 28 and engages with the hook 27' of the clamp 27 in its open state and is locked in that position.

As a releasing means, it is possible to use another releasing means which extends into and withdraws from the moving route of the clamping mechanism, such as cams and pins, instead of the limiting bar 44, to provisionally release the above lock.

In the drawings, the numeral 47 is an optical sensor of a light reflection type for detecting the presence or absence of the cloth W by the light reflected from the cloth sliding plate 13. When the front end or rear end of the cloth W is detected by the sensor 47, it is designed to enter its signal to a control unit 48 beneath the table 11. The numeral 49 is a proximity sensor which detects the clamping mechanism 23 when the clamping mechanism 23 is at the waiting position to clamp the delivered cloth from the sewing machine 12, and inputs the signal into the control unit 48. In the control unit 48, a program to control a sewing machine motor, step motor 19, air cylinders 35, 37, 39, air nozzle 42 and others is incorporated, and it is designed to control them according to the input signals from the sensors and rotation signals from the main shaft of the sewing machine.

Operation

In the state shown in FIG. 1, where the clamping mechanism 23 is at the waiting position, after setting a cloth W on the sewing machine 12 in a conventional way, a switch for starting the sewing machine motor on the control unit 48 is turned on to drive the sewing machine. The sewing action advances the cloth W and the sewn cloth W is sent out from the sewing machine and moves on to the cloth sliding plate 13, which is positioned slightly nose-down, and the sewn cloth's W front end enters between the receiving plate 24 and the clamp 27, which is open. The sensor 47 detects the front end of the cloth W before it reaches the clamping mechanism 23, and inputs its signal into the control unit 48. The control unit 48, at first, changes over the change-over valve (not shown) of the air cylinder 37 according to the input signal, operates the air cylinder 37 to close the clamp 27, and engages the hook 27' with the latch 29' of the latch lever 29 by the spring 28, thereby pinching and clamping the inserted cloth end by the sponges 31. Here, as soon as the piston rod of the air cylinder 37 reaches its furthest extension, it is withdraw by the change-over valve. Next, the step motor 19 is started, and the clamping mechanism 23 starts moving clockwise left with the chains 22 (the upper clamping mechanism moves to the right) while clamping the cloth end, and at the same time, the change-over valves (not shown) of the air cylinder 35 and air cylinder 39, are switched over so that the air cylinders 35, 39 act to lower the cloth sliding plate 13 and extend the cloth hanging rod 40. When the cloth length is short, the cloth sliding plate 13 should not always be tilted down.

During the moving way of the clamping mechanism 23 to the left with the clamped cloth end, the cloth hanging rod 40 supports the back of the cloth. When the sewing machine 12 is temporarily stopped, or when the cloth feeding is stopped, by pressing the cloth by a pen-shaped air cylinder (not shown) and delivering a pen signal for the purpose of cutting thread chain, the step motor 19 is stopped temporarily. When the clamping mechanism 23 reaches the limiting bar 44, the change-over valve of the air nozzle 42 is changed to blow out air downward from the air blow-out port onto the cloth W hung between the clamping mechanism 23 and the cloth hanging rod 40, thereby forcing it down from the cloth hanging rod 40. The latch lever 29 is moved counterclockwise in FIG. 2 by the limiting bar 44, and by this movement, the lock, which is engaged by the hook 27' with the latch 29', is released, and hence, the clamp 27 opens to set the cloth end free. The released cloth W falls down onto the cloth holding stand 45. The clamping mechanism 23 keeps rotating and moves to its right at its left end, upward to the upper left position shown in FIG. 1, and further to the right to reach the lower right position, that is, the waiting position. When the proximity sensor 49 detects it, a signal is entered in the control unit 48. The control unit 48 changes the change-over valves of the air cylinder 35 and air cylinder 39 respectively depending on the input signal so as to raise the cloth sliding plate 13 and to withdraw the cloth hanging rod 40, and, at the same time, to stop the step motor 19 and the air flow from the air nozzle 42. Accordingly, as soon as the cloth sliding plate 13 rises, it becomes possible to detect the cloth by the sensor 47.

The above action is executed whenever the cloth sewn by the sewing machine is sent out, and the cloths are piled up sequentially on the cloth holding stand 45.

The Second Embodiment

Figure 6:
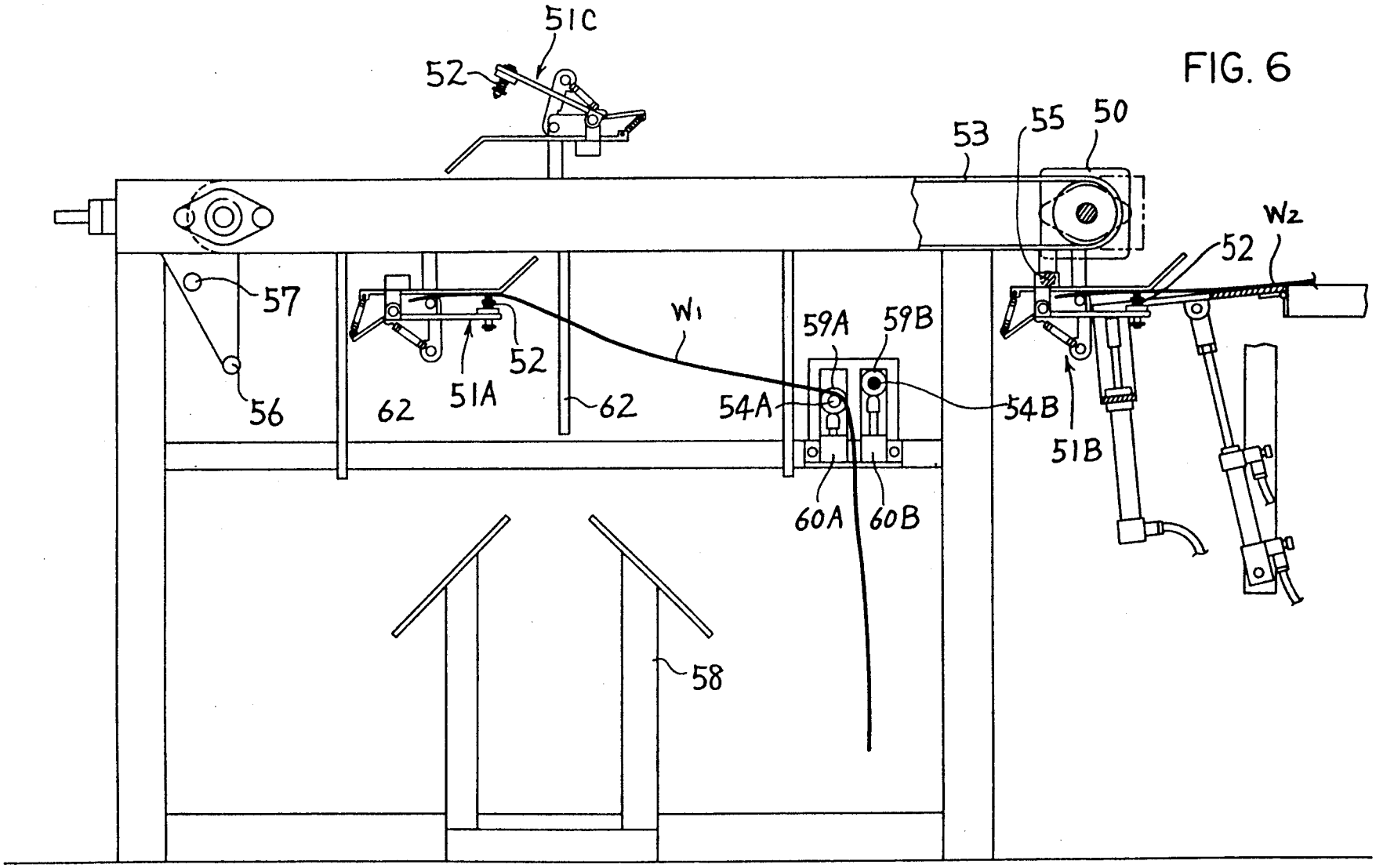
FIG. 6 and FIG. 7 are front views of second embodiment of the invention showing its operations in sequence.
Figure 7:
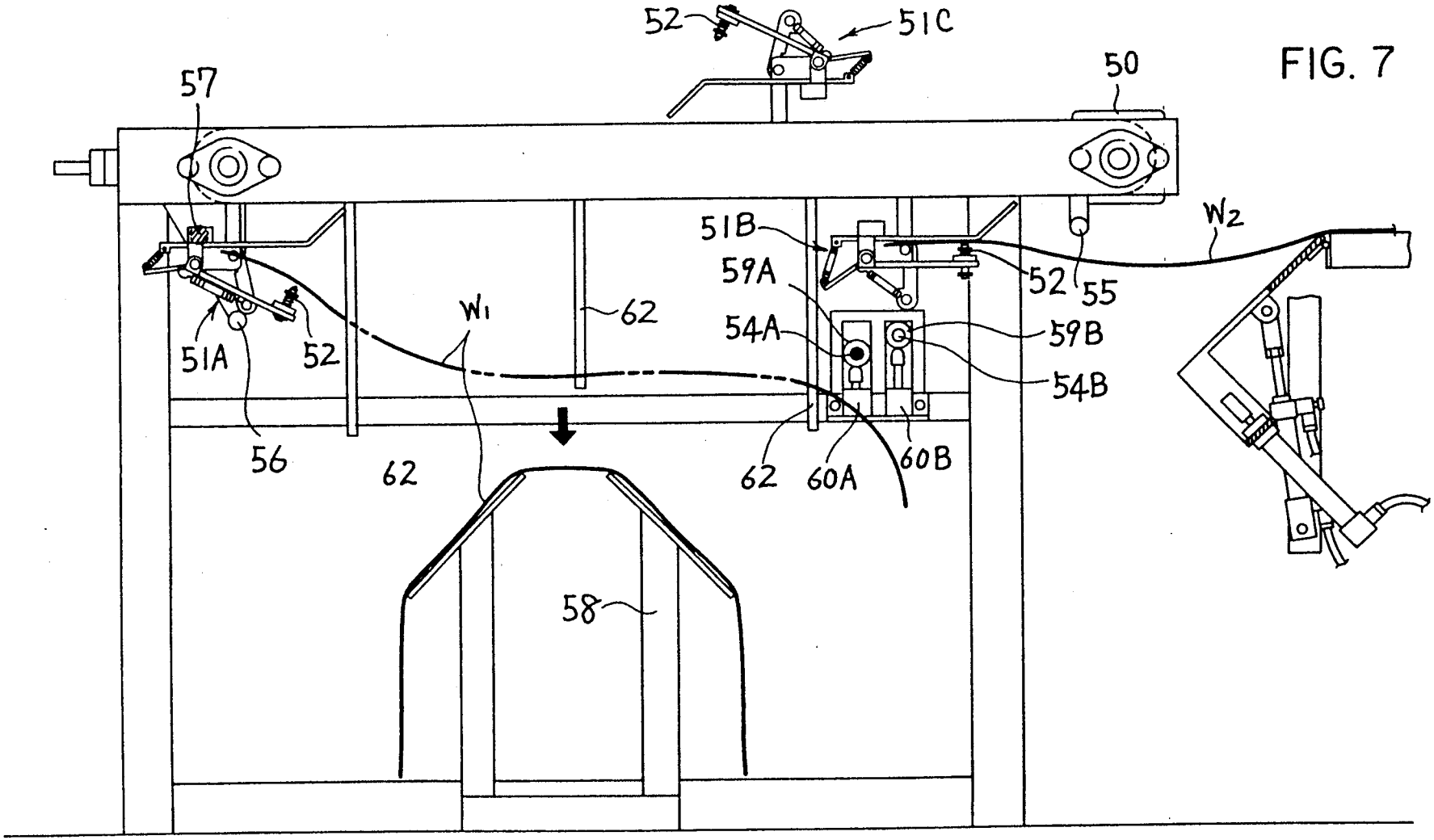

The stacking device shown in FIGS. 6 and 7 are designed to operate at high speed, in which clamping mechanisms 51A, 51B, 51C are mounted at shorter intervals than in the above embodiment on a belt conveyor 53 which is driven by a step motor 50 through a pulley. Before the clamping mechanism 51A releases the clamped cloth W1, the next clamping mechanism 51B is designed to start conveying the next cloth W2 by clamping. Each clamping mechanism has a pair of parallel, installed pins 52 (FIGS. 6 and 7 show only a foreground pin) being biased to extend by a specific amount by a spring, instead of a sponge, so that a heavy and thick cloth can be clamped securely. The remaining structure is the same as the clamping mechanism 23 of the foregoing embodiment except that there, the cloth is clamped by being pressed by the pins 52.

Beneath the circulation route of the clamping mechanisms, a pair of cloth hanging rods 54A, 54B are disposed in parallel to the feeding direction. These rods 54A, 54B are designed to move alternately in the horizontal direction, orthogonal to the cloth feeding direction by means of air cylinders 59A, 59B, and move vertically alternately by means of air cylinders 60A, 60B. When one rod, for example, the rod 54A, is extended to the cloth supporting position, the other rod 54B retracts to an upsupporting position. That is, into the cylinder 59B. These rods extend to be ready for the supply of cloth when located at their upper position, descend after supporting the cloth, and then retract to release the cloth.

When it is arranged so that the retraction of one rod is started after the retraction of the other rod is completed, it is not necessary to move the rods vertically. However, by moving the rods vertically, it is possible to operate at higher speed.

When both rods move simultaneously, and one rod is in its extending process and the other in its retracting process, the cloth is laid down onto the rod at its upper position, and not on the rod at its lower position, and then, the cloth released from the rod at the lowered position is not placed again on the rod at the raised position, thereby allowing operation at higher speeds. It is the same if the rod at the upper position extends before the rod at the lower position retracts and both rods are in the extended state.

The vertical motion of the rod is started when the clamping mechanism reaches the waiting position and is detected by a proximity sensor 55, and the forward or backward motion is effected when the clamping mechanism reaches a limiting bar 56 where it is detected by a proximity sensor 57. Release of the clamping mechanism by the limiting bar 56 and detection of the clamping mechanism by the proximity sensor 57 may be done simultaneously, or the timing of release and detection of the clamping mechanism may be changed by varying the position of the limiting bar or proximity sensor.

In the drawing, numeral 62 denotes a guard bar for preventing the cloth from moving together with the rod in the lateral direction when the rod supporting the cloth retracts.

In this embodiment, the air nozzle 42 shown in the foregoing embodiment is not used.

Operation

Figure 8:
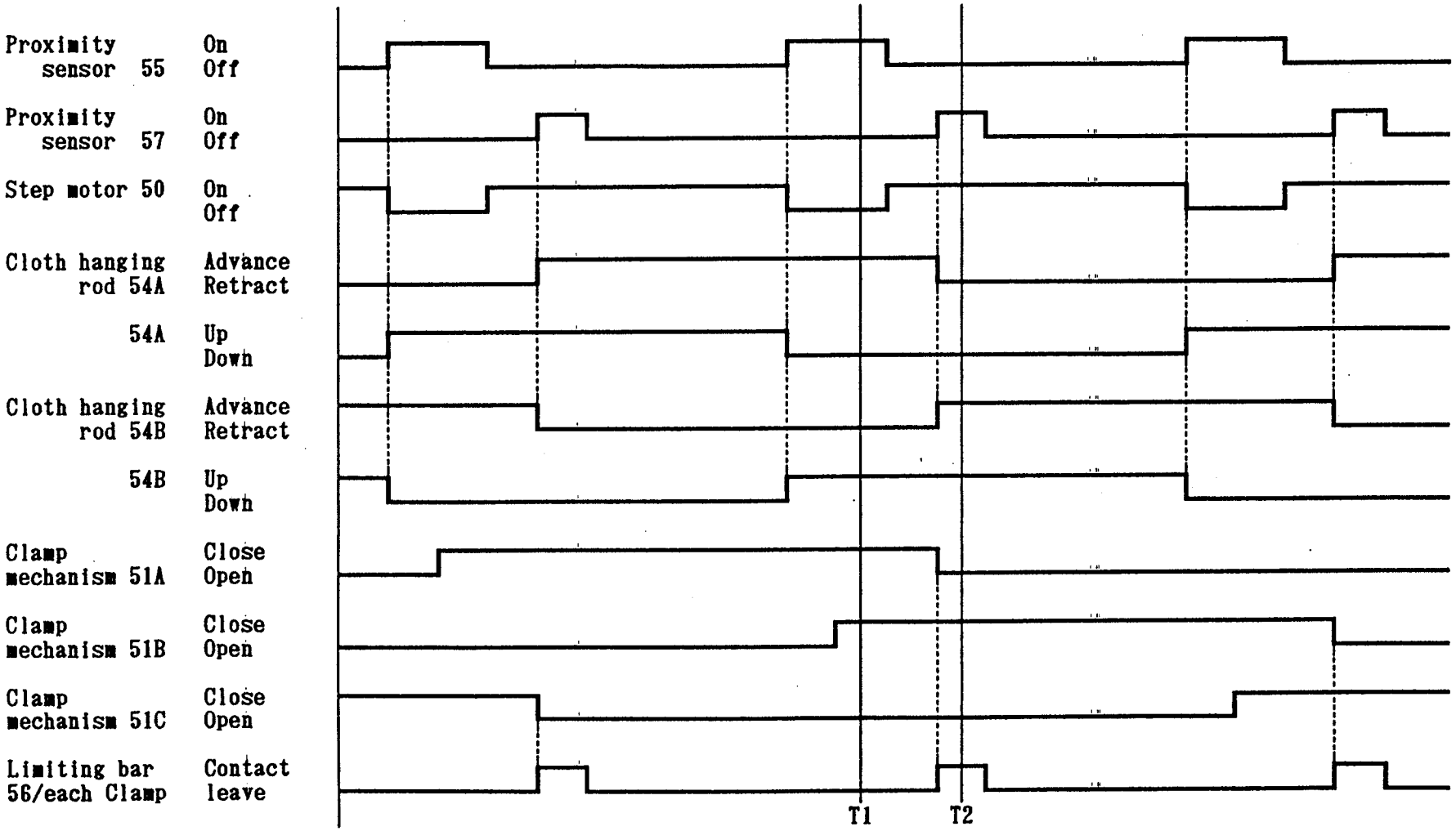
FIG. 8 is a time chart for the second embodiment.

The operation timing of this device is shown in FIG. 8, and the state of the device at T1 in the diagram is shown in FIG. 6 and the state of the device at T2 is given in FIG. 7.

As shown in FIG. 6, while the clamping mechanism 51A is, by clamping the cloth edge, moving leftward and pulling the cloth W1 laid down on the cloth hanging rod 54A, the next clamping mechanism 51B reaches the waiting position, and when it is detected by the proximity sensor 55, the step motor 50 for driving the belt conveyor stops, and the cloth hanging rod 54A descends, and the air cylinder 59B, in which the cloth hanging rod 54B is inserted, raises. In succession, the next cloth W2 is clamped in the same manner as in the above embodiment, and the step motor is driven, so that the clamping mechanisms 51A, 51B move leftward.

Meanwhile, the start timing of the step motor is determined by a timer.

When the clamping mechanism 51A reaches the limiting bar 56 and the proximity sensor 57 detects the clamping mechanism 51A, the cloth edge is released from the clamping mechanism 51A by the limiting bar 56, and simultaneously the cloth hanging rod 54A retracts, and the cloth W1 is dislocated from the rod 54A, the cloth W1 then drops onto the cloth holding stand 58 as indicated by the arrow in FIG. 7. Meanwhile, simultaneously with the retraction of the cloth hanging rod 54A, the cloth handing rod 54B extends beneath the cloth W2, and supports the cloth W2. When the motor further rotates until the clamping mechanism 51C reaches the waiting position, the motor stops. At this time, the clamping mechanism 51B stops at the position of the clamping mechanism 51A as shown in FIG. 6, with the cloth edge being clamped.

What is claimed is:

1. A stacking device for a sewing machine comprising a conveyor driven along a circulation route; means for clamping a work article, said clamping means being attached to the conveyor and spring-biased to an open position; means for closing the clamping means positioned along the circulation route, said closing means being independent from said clamping means; means for locking the clamping means in a closed state; and releasing means for unlocking said clamping means, said releasing means being positioned along the circulation route.

2. A stacking device for a sewing machine comprising a conveyor driven along a circulation route; a supporting bracket attached to the conveyor; clamping means comprising a clamp and locking means for the clamp, said clamp being attached to the supporting bracket and biased to an open position and said locking means comprising a hook and a latch and being actuated by the closing of the clamp to lock the clamp in a closed state, said clamping means accompanying said conveyor along said circulation route; means for closing said clamp by engagement therewith; and releasing means for unlocking said clamp.

3. A stacking device according to claim 2, wherein the locking means is a lever equipped with an engaging part which is biased in a direction by a spring to engage with a clamp, and when the clamp is closed, the clamp is engaged with the engaging part to be locked.

4. A stacking device according to claim 1 or 2, wherein the closing means are air cylinders.

5. A stacking device according to claim 1 or 2, wherein a cloth clamping part of the clamp is made of an elastic material which clamps the cloth elastically in the closed state.

6. A stacking device according to claim 1 or 2, wherein pins being biased so as to extend a specific extent by a spring are disposed at a cloth pinching part of the clamp.

7. A stacking device according to claim 1 or 2, wherein the releasing means comprises a detent installed proximately to the route of the clamping means and the locking means is unlocked by the contact of said releasing means against the locking means.

8. A stacking device according to claim 1 or 2, wherein an inclining sliding plate for supporting a cloth to be fed is installed on a cloth feeding side of the conveyor and a cloth hanging rod is provided beneath the conveyor, the cloth hanging rod being movable in a direction orthogonal to a cloth feeding direction.

9. A stacking device according to claim 1 or 2, wherein the releasing means is positionally adjustable in a direction of a movement of the clamping means.

10. A stacking device according to claim 1 or 2, wherein plural or multiple clamping means are installed on the conveyor at specific intervals.

11. A stacking device according to claim 1 or 2, wherein plural or multiple clamping means are disposed at specific intervals, and plural cloth hanging rods are provided beneath the conveyor, and said cloth hanging rods extend at an upper position and retract at a lower position and move vertically between the upper and lower positions at shifted timings, and a cloth clamped by the clamping means is supported by a cloth hanging rod extending at the upper position, and falls from the rod retracting at the lower position.

12. A stacking device for a sewing machine comprising a conveyor driven in a circulation route, a plurality of clamps mounted on the conveyors at specific intervals, each of said clamps being biased in an opening direction by a spring, means for closing the clamps, means for locking the clamps in a closed state, means for unlocking the clamps at a predetermined arbitrary position on the conveyor circulation route, and plural cloth hanging rods disposed so as to be able to extend and retract in a direction orthogonal to a cloth feeding direction and move vertically beneath the circulation route.

13. A stacking device according to claim 1, wherein said cloth hanging rods are a pair of rods disposed in parallel relationship so as to extend and retract and move vertically alternately to each other, one rod extends at an upper position to support a first cloth, thereafter moves to a lower position and then retracts to release the first cloth, while the other rod extends at the upper position simultaneously to support a second cloth.

14. A stacking device according to claim 12, wherein the cloth hanging rods begin moving in response to a signal of a sensor for detecting a position of the clamp.

15. A stacking device for a sewing machine comprising a conveyor driven along a circulation route; a plurality of clamps mounted on the conveyor at specific intervals; means for opening the clamps; means for closing the clamps; means for maintaining the clamps in a closed state; and plural cloth hanging rods disposed in parallel relationship, said cloth hanging rods being mounted for reciprocating movement in a direction orthogonal to a cloth feeding direction and vertical movement underneath said circulation route.

16. A stacking device according to claim 15, wherein said plural cloth hanging rods are a pair of rods disposed in parallel relationship, each of said pair of rods being mounted for movement in a direction opposite to the direction of movement of the other of said pair of rods so that when one rod extends at an upper position to support a second work article and then moves to a lower position and retracts in order to release the second work article, the other rod simultaneously retracts at the lower position to release a first work article and then moves to the upper position and extends to support a third work article.

* * * * *

UNITED STATES PATENT AND TRADEMARK OFFICE

CERTIFICATE OF CORRECTION

PATENT NO. : 5 018 463

DATED : May 28, 1991

INVENTOR(S) : Nobuo NAKAJIMA

It is certified that error appears in the above-identified patent and that said Letters Patent is hereby corrected as shown below:

Column 7, line 16; change "a" to ---the---.

Column 8, line 16; change "claim 1" to ---claim 12---.

Signed and Sealed this

Thirteenth Day of October, 1992

*Attest:*

DOUGLAS B. COMER

*Attesting Officer*

*Acting Commissioner of Patents and Trademarks*